United States Patent [19]

Fredman

[11] 4,354,287

[45] Oct. 19, 1982

[54] BED FRAME WITH ADJUSTABLE HEADBOARD ENGAGER OR ENGAGER-EXTENDER

[76] Inventor: Harry Fredman, 908 S. Washington St., Peoria, Ill.

[21] Appl. No.: 167,526

[22] Filed: Jul. 11, 1980

[51] Int. Cl.[3] ..... A47C 19/04

[52] U.S. Cl. ..... 5/185; 5/201; 5/202

[58] Field of Search ..... 5/185, 201, 205, 208, 5/238, 202, 296, 282 R, 288; 248/225.2, 73, 243; 408/187, 206, 230, 245

[56] References Cited

U.S. PATENT DOCUMENTS

| | | | |
|---|---|---|---|
| 2,169,138 | 8/1939 | Causey | 5/296 |
| 2,311,111 | 2/1943 | Kelly | 5/296 |
| 2,905,416 | 9/1959 | Wiegand | 403/245 |
| 3,761,970 | 10/1973 | Fredman | 5/201 |
| 3,983,823 | 10/1976 | McDonnell | 248/243 |

*Primary Examiner*—Roy D. Frazier
*Assistant Examiner*—Michael Trettel
*Attorney, Agent, or Firm*—Harvey B. Jacobson

[57] ABSTRACT

A bed frame having generally parallel side rails which can be laterally adjusted to fit standardized twin, full and queen size beds with each side rail including an inwardly extending end plate with each end plate being provided with an engager in the form of a hook plate having a pair of hooks along one vertical edge thereof for orientation in an upwardly opening position or a downwardly opening position to hook under the pins in the headboard to lift the headboard off the floor or to hook over the pins so that heavier headboards can rest on the floor. Each engager is provided with a vertical slot spaced from the hooks and the opposite vertical edge of the plate for receiving the end plate on the side rail to enable lateral adjustment of the engager in relation to the end plate and reversibility of the engager so that the hooks face upwardly or downwardly. Each of the end plates is provided with a pair of parallel slots to enable headboards which may or may not be predrilled and not slotted and pinned to be supported from the bed frame. The vertical slots in the engagers fit and slide over the entire end plate thereby providing easy attachment without measuring or guessing as to which slot the end plate fits into. A more stable arrangement is provided by the camming action of the pins engaging the hooks which pulls the full width and vertical length of the end plate on the side rail of the bed frame snugly against the leg of the headboard thereby providing a stable and rigid connection between the side rails and headboard. An engager-extender is provided to enable queen size bed frames to be connected with headboards which have the pins and slots spaced apart to receive a full size bed.

14 Claims, 10 Drawing Figures

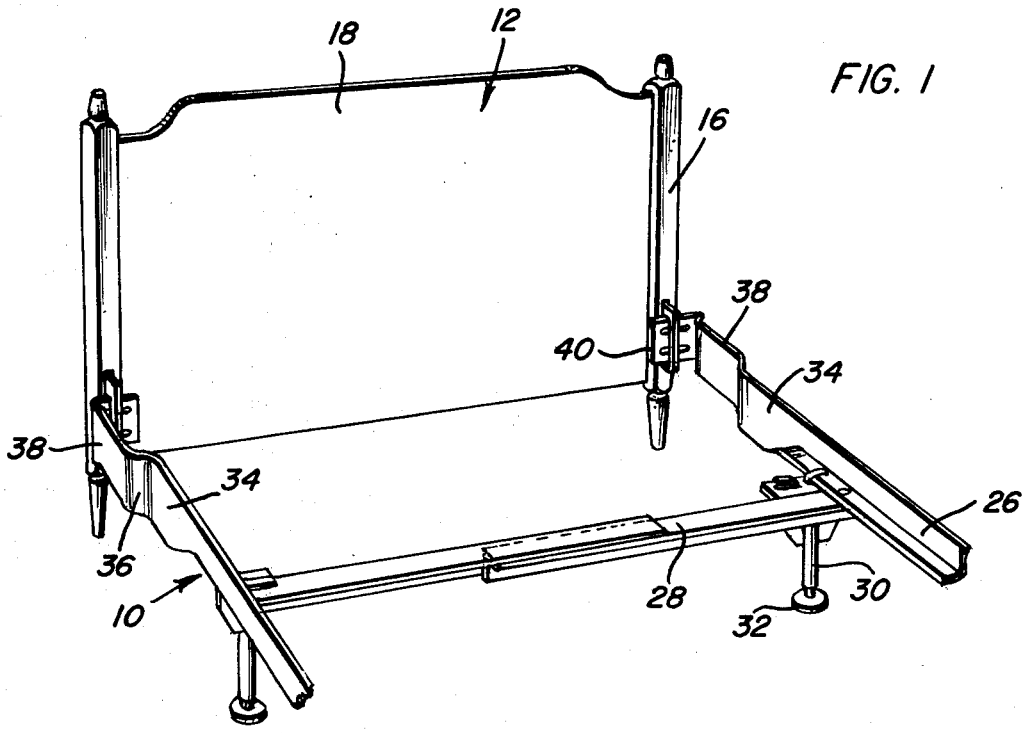
FIG. 1
FIG. 6
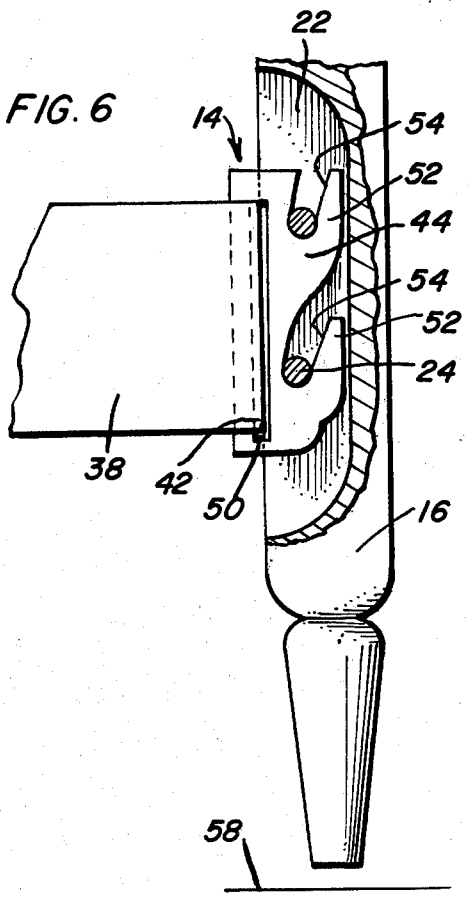
FIG. 5
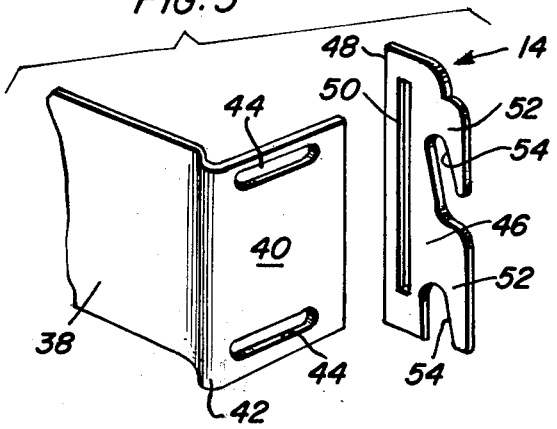

FIG. 7
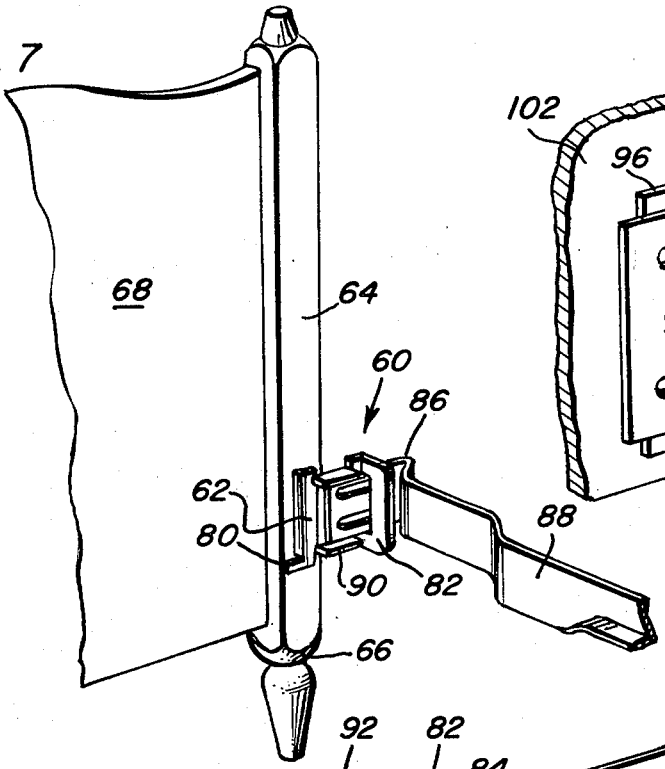
FIG. 10
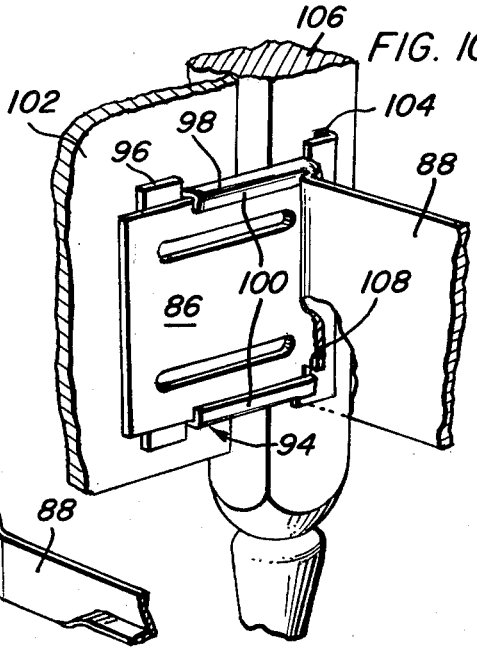
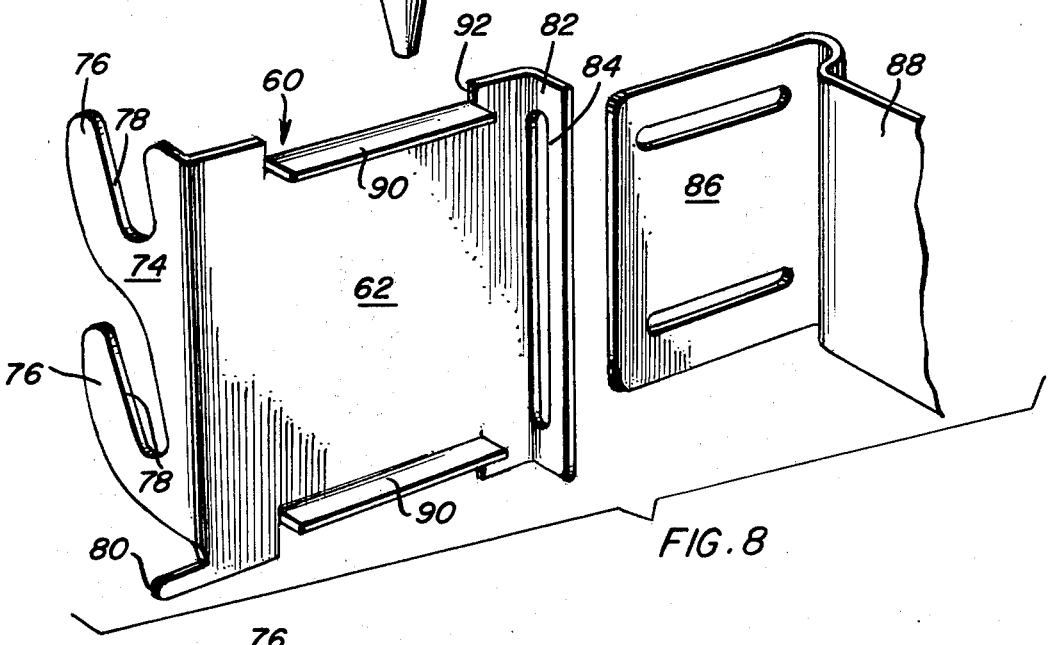
FIG. 8
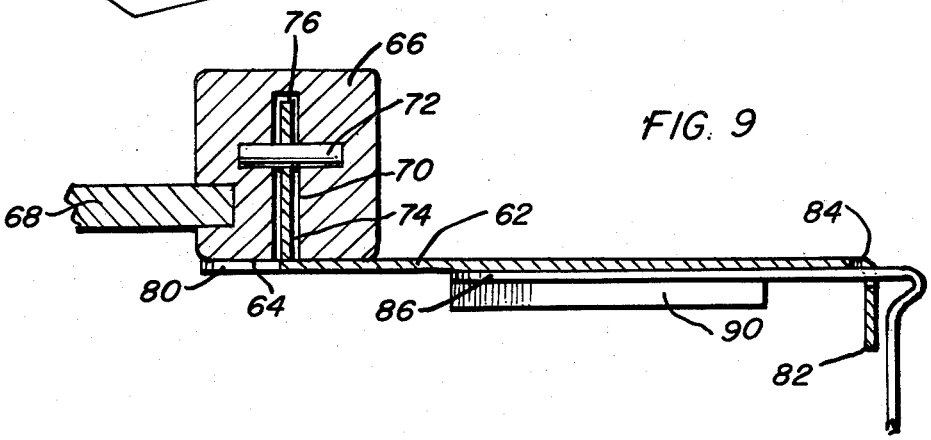
FIG. 9

BED FRAME WITH ADJUSTABLE HEADBOARD ENGAGER OR ENGAGER-EXTENDER

BACKGROUND OF THE INVENTION

The present invention generally relates to a bed frame with inwardly extending end plates at the end or ends of each side rail and an engager or engager-extender laterally slidably mounted on each of the end plates with the engager being in the form of a hook plate having a pair of hooks on one vertical edge thereof and a vertically disposed slot spaced from the hooks for sliding engagement over the end plate so that when the hooks are engaged with the slot and pins in a headboard of a bed, the camming action between the hooks and pins will pull the outer surface of the end plate rigidly against the slotted surface of the leg of a headboard thereby providing a stable and rigid connection between the bed frame and headboard with the slot in the hook plate enabling the hook plate to be engaged with the slots and pins in headboards which deviate from the standard distance between the slots and pins in the headboard. In one embodiment of the engager-extender includes the hooks and slots but the plate includes a laterally extending portion with vertically spaced flanges receiving the end plate on the side rail to enable queen size bedding to be associated with a headboard constructed for full size bedding, or by reversing the engager-extenders to extend beyond the correctly opened full size frame to engage a bed slotted wider than the standard full size spacing (53" to 54").

The following U.S. patents are examplary of structures provided to connect headboards with bed frames which, in some instances, include structure so that non-standardized bed frames and headboards can be connected.

U.S. Pat. Nos.

2,728,924-Jan. 3, 1956-Mutchnik
2,845,636-Aug. 5, 1958-Iaquinta et al
2,942,279-June 28, 1960-Von Canon
2,947,999-Aug. 9, 1960-Hooker
3,210,780-Oct. 12, 1965-Hooker
3,368,227-Feb. 13, 1968-Underdown
3,793,655-Feb. 26, 1974-Harris et al
2,784,421-Mar. 12, 1957-Fredman
3,118,151-Jan. 21, 1964-Fredman
Re.27,182-Sept. 21, 1971-Fredman
3,644,948-Feb. 29, 1972-Fredman
3,761,970-Oct. 2, 1973-Fredman
4,080,574-Mar. 28, 1978-Fredman et al
4,146,940-Apr. 3, 1979-Fredman et al.

U.S. Pat. No. 3,368,227 provides lateral adjustment of a hook plate in relation to the side rail of a bed frame by the use of a rather loose fitting hook assembly which does not require bolting, while other of the patents, such as U.S. Pat. Nos. 2,845,636 and 2,942,279 disclose laterally adjustable hook plates which are bolted on, which attaching procedure introduces problems when assembling and the possibility of the secured bolts becoming loosened.

SUMMARY OF THE INVENTION

An object of the present invention is to provide a bed frame with end plates on the side rails thereof and an engager mounted on each end plate for lateral adjustment with each engager including hooks engageable with the slot and pins provided on headboards in order to connect the headboard to the bed frame.

Another object of the invention is to provide a bed frame and engagers as set forth in the preceding object in which each of the engagers is in the form of a flat hook plate having a vertical slot therein and a pair of hooks along one edge thereof for engaging the headboard pins with the vertical slot slidably receiving and thus being slidably mounted on inturned end plates on the bed frame rails thereby enabling the bed frame to be effectively and rigidly connected to headboards having different horizontal distances between the vertical slots and pins.

A further object of the present invention is to provide a bed frame and engagers as set forth in the preceding objects in which the hook plate is reversible so that the hooks can open upwardly to lift the headboard off the floor when the hooks are engaged with the pins in the headboard or face downwardly to engage over the pins so that heavy headboards and the frame will rest firmly on the floor surface.

Still another object of the invention is to provide a headboard and engagers as set forth in the preceding objects in which the end plates on the frame rails are of unitary construction with the frame rails and perpendicular thereto and provided with a substantial horizontal and vertical extent and a pair of horizontal, parallel slots to enable adjustable connection to headboards which have been predrilled at the factory and are not slotted and pinned with the horizontal slots in the end plate enabling installation of predrilled headboards having different horizontal distances between the predrilled holes and enabling assembly of headboards which must be drilled at the site of assembly with the bed frame.

An important object of the present invention is to provide engager-extenders in accordance with the engagers set forth in the preceding objects with the plate on which the hooks and slots are formed including a laterally extending portion to offset the hooks from the slots whereby side rails supporting queen size bedding can be connected to headboards with slots and pins adapted to receive a full size bed frame.

A still further object of the invention is to provide a bed frame and engagers as set forth in the preceding objects in which the engagers or engager-extenders are quite simple in construction, easy to install and attach without the use of any extraneous fasterners and without requiring any tools, but yet rigidly connecting and stabilizing the connection between the headboard and bed frame.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmental, perspective view of a bed frame and headboard illustrating the engagers of the present invention connecting the headboard to the frame rails.

Figure 3:
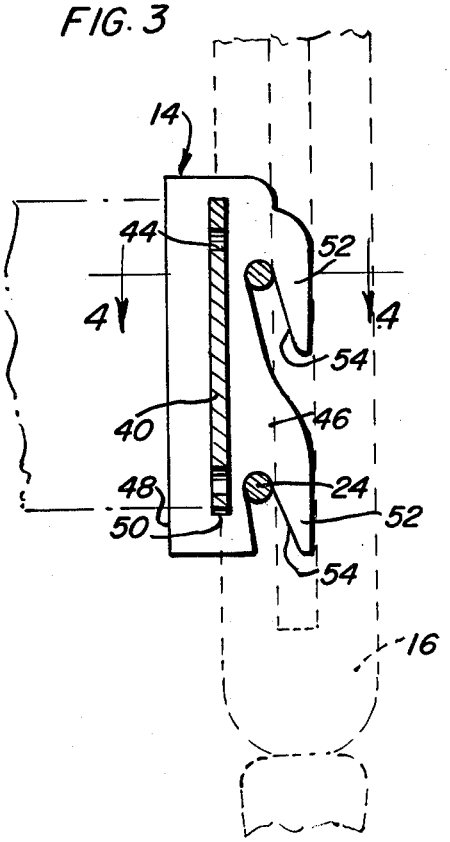
FIG. 3 is a vertical, sectional view taken substantially upon a plane passing along section line 3—3 of FIG. 2 illustrating further the relationship between the components.
Figure 4:
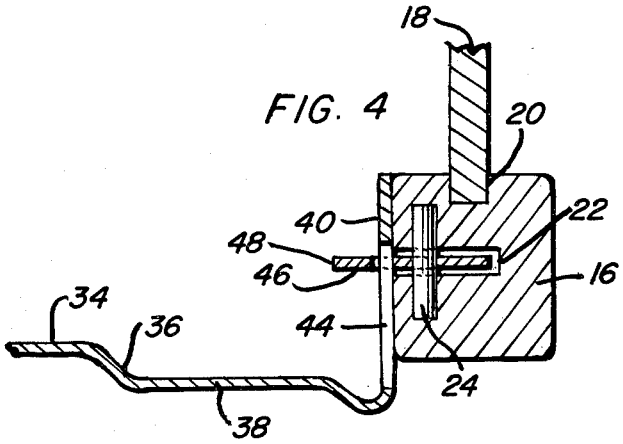

FIG. 4 is a transverse, plan sectional view taken substantially upon a plane passing along section line 4—4 of FIG. 3 illustrating further details of the relationship between the components of the present invention.

FIG. 5 is an exploded, group perspective view of one of the end plates and engagers.

FIG. 6 is a sectional view similar to FIG. 3 but illustrating the engager inverted with the hooks opening upwardly to support the leg of the headboard in spaced relation to the floor surface.

FIG. 7 is a fragmental perspective view of another embodiment of the engager-extender of the present invention.

FIG. 8 is a group perspective of the engager-extender and the adjacent end portion of a frame side rail.

FIG. 9 is a horizontal sectional view illustrating the assembled relationship of the components of this embodiment of the invention.

FIG. 10 is a fragmental perspective view of a third embodiment of the engager-extender.

DESCRIPTION OF THE PREFERRED EMBODIMENT

Referring now specifically to FIGS. 1–6 of the drawings, there is disclosed an adjustable width bed frame 10, a headboard 12 connected thereto and a pair of engagers, each being designated generally by reference numeral 14, which connect the headboard 12 to the bed frame 10. The headboard 12 or footboard is of conventional construction and includes a pair of vertically disposed legs or posts 16 interconnected by a vertical panel 18. As illustrated in the various figures of the drawings, the legs 16 may be of any suitable height and the panels 18 may also be of any suitable height with the panels being secured to the legs in a conventional manner, such as by the side edges thereof being received in a groove 20, as illustrated in FIG. 4. Also, each leg 16 is provided with a vertical slot 22 therein and a plurality of horizontally disposed, vertically spaced pins 24 extending transversely of the slot 22 inwardly from the entrance edge to the slot 22. All of the structure of the headboard or footboard is conventional and in and of itself does not constitute part of the present invention, except for its unique relationship to the engagers 14 and bed frame 10. Conventional headboards or footboards are provided with standardized dimensions in which the slots 22 are oriented a predetermined distance apart with this distance being standardized for twin, full and queen size beds, but in actual manufacturing, considerable variations exist in this distance.

Figure 2:
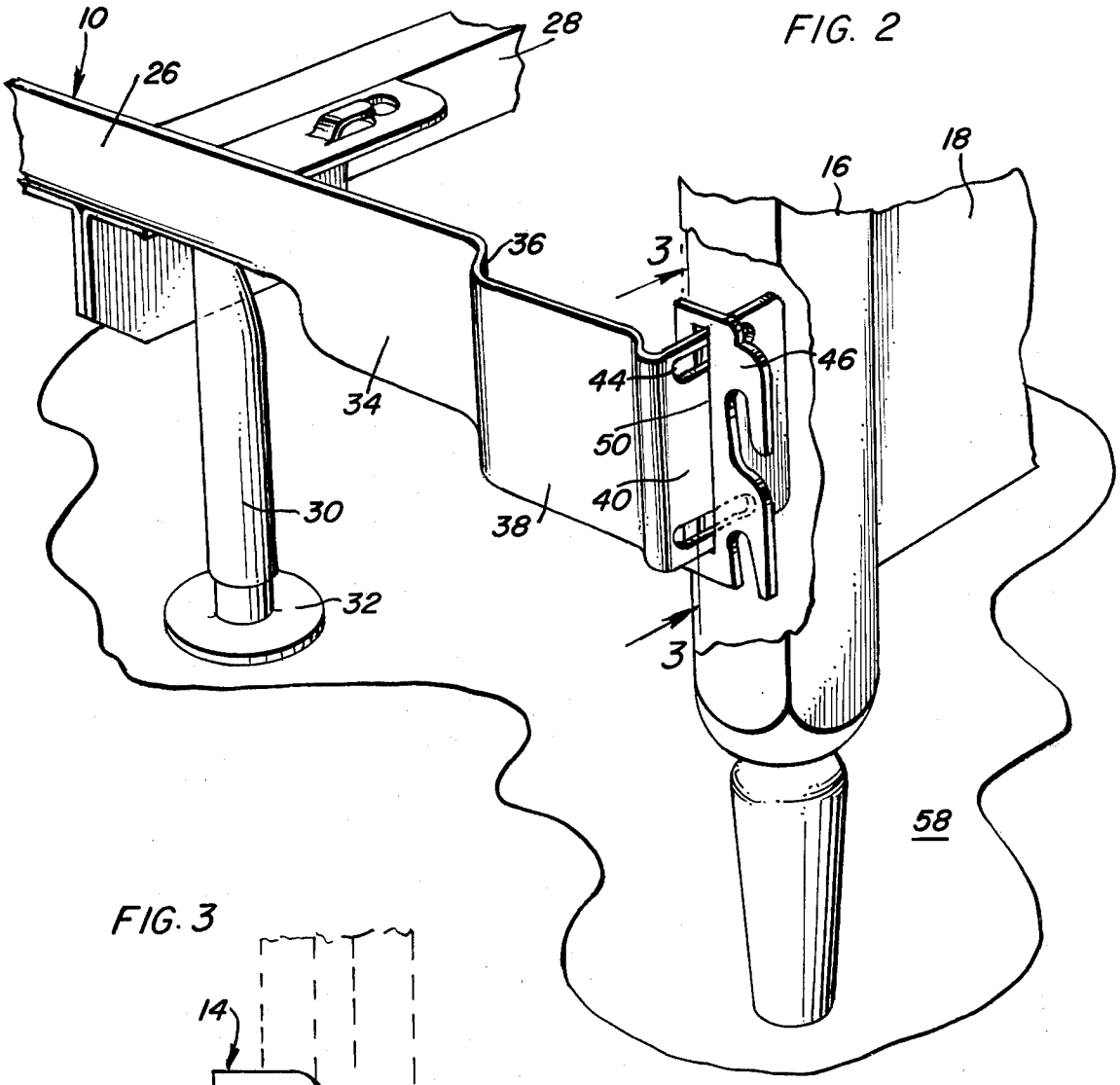
FIG. 2 is a fragmental, perspective view illustrating the association of one of the engagers with the end plate on the frame side rail and the leg on a headboard.

The bed frame 10 includes side rails 26 each of which includes an inturned bottom flange and a vertically extending side flange at the outer edge thereof with the side rails 26 being adjustably interconnected by a cross rail 28 and supported by supporting legs 30 having a glide or castor 32 at the lower end thereof which can be vertically adjusted. The cross rails 28 can be adjusted so that the rails 26 are set at standardized widths with the specific structure of the adjustable cross rails and supporting leg structure being conventional and forming no specific part of the present invention. However, the ends of the side rails 26 are specially constructed in that they include a vertical plate 34 forming a continuation of the side rail 26 which due to the material from which the side rail is constructed provides some lateral resiliency to the end portion of the rail 26. The vertical plate 34 is provided with a laterally offset portion 36 and a longitudinally extending portion 38 which is outwardly offset in relation to the end plate 34 as illustrated in FIG. 2. The outer end of the longitudinal end 38 of the side rail 26 is provided with an inturned end plate 40 which is perpendicular to the side rail 26 and unitary with the end of the longitudinal extension 38 and connected therewith by a partially cylindrical outwardly offset curved portion 42, as illustrated in FIG. 4 to introduce some degree of resiliency between the end plate 40 and the longitudinal extension 38. The end plate 40 is substantially planar on its outwardly facing surface which is oriented towards and against the face of the supporting leg 16 of the headboard 12. Adjacent the top and bottom edges of the end plate 40 is a pair of horizontal slots 44 which are perpendicular to the vertical side edges of the end plate 40 and extend over a major portion of the width of the end plate 40, as illustrated in FIG. 5. The slots 44 are for receiving fastening bolts, screws, or the like, used to secure the bed frame 10 to a headboard of the type which does not have vertical slots and horizontal pins and which has been predrilled at predetermined spaced points to receive such fasteners. The slots 44 accommodate variation in the horizontal distance between the predrilled holes.

To connect the end plates 40 to the headboard 12, a pair of reversible engagers 14 are provided with each end plate engager being in the form of a substantially flat hook plate 46 having one straight vertical edge 48, a vertical slot 50 extending substantially throughout the vertical length of the plate in spaced parallel relation to the vertical edge 48 and a pair of hooks 52 incorporated into the other vertical edge of the plate 46 with the hooks adapted to be engaged with the pins 24 when the hook plate 46 is inserted into the slot 22, as illustrated in FIGS. 3, 4 and 6. The outer edge surfaces of the hook slots, designated by reference numeral 54, an outwardly inclined in a manner to provide a camming action when the hooks 52 are engaged with the pins 24, so that vertical movement of the hook plate 46 will cause the hook plate 46 to move inwardly into the slot 22 until the pins 24 engage the inner ends of the hook slots. Thus, when the engager 14 is mounted on the end plate 40 by positioning the slot 50 laterally onto the end plate 40, the lateral position of the engager 14 may be horizontally adjusted so that the hooks 52 can be aligned with the slot 22. Then when the hooks 52 are engaged with the pins 24 and moved vertically in relation thereto, the camming action of the pins 24 against the cam surfaces 54 will pull the flat surface of the end plate 40 tightly against the face of the leg 16 of a headboard 12 thereby providing a rigid and stable connection between the leg 16 and the frame rail 26. Thus, no fasteners or bolts are necessary to secure the headboad to the bed frame and the lateral adjustment permitted by the slot 50 rather closely fitting but slidable on the end plate 40 provides lateral adjustment so that the hooks 52 can be inserted into the slot 22 into engagement with the pins 24 even though the distance between the slots 22 in the two legs 16 on the headboard 12 may vary considerably from a standard width.

As illustrated in FIGS. 3 and 6, the hooks 52 may be positioned so that they open upwardly, as in FIG. 6, so that the headboard 12 is supported in spaced relation from the floor 58 so that the assembled bed may be easily moved by the glides 32 being rather easily moved along a floor surface. When desired, such as when a relatively heavy headboard is to be supported, the engager 14 is inverted so that the hooks 52 open downwardly, as illustrated in FIG. 3, so that the bottoms of the legs 16 and the frame will be firmly supported from the floor surface.

Thus, with the present invention, there is provided a simple and economical arrangement for rapidly and permanently securing a headboard to a bed frame without the use of nuts and bolts or other fastening devices and without the use of any tools so that assembly can be accomplished by a consumer, delivery person, or other skilled or unskilled persons, with the arrangement providing a choice of supporting the headboard above the floor as is recommended for lighterweight constructed headboards or permitting the legs of the headboard to rest on the floor which has been recognized as being necessary for heavier style headboards.

Numerous bed frames with four supporting legs are available which are constructed to open to the standard twin, full and queen sizes of bedding without the use of nuts and bolts, but all of these bed frames require the use of bolts and nuts to attach the headboard to the bed frames which is a time consuming and costly job and the person assembling the headboard frequently is confronted with a variety of frustrating and inherent problems. For example, there is a large variety of different thickness leg posts on headboards, frequently the correct length bolt is not in stock or immediately available, bolts which are too long protrude and scratch walls, difficulty is encountered when holes are not properly predrilled and when longer bolts are broken off, the thread is frequently disturbed and the nut cannot be properly removed or replaced for taking apart the bed. Many older style full size beds in use cannot be fitted to the preset size bed frames as the frame is narrow and often misses the wood of the legs of the headboard and in this case, adapter plates are required which utilize additional nuts ands bolts which must be properly fitted. In other existing bed assemblies, hooks are used that do not require bolting to the headboard but they usually require bolting to the frame which is also time consuming and frequently needs retightening.

It is pointed out that the thickness of legs on the headboard and weight of the headboard must continue to vary depending upon the style, size and material used. Therefore, the problem of different size bolts will always exist. Also, the inability of the factory to predrill the headboard in advance and give the consumer the option of lifting the headboard off the floor or keeping the headboard firmly on the floor would always require the dealer or consumer to custom drill his headboard to enjoy this benefit.

By using the engager of the present invention, the manufacturer will continue to slot the legs of a headboard in a conventional manner and set the lower pin at the recommended standard 7" height which is recommended by the National Bureau of Standards and used by most manufacturers inasmuch as it results in the top of the mattress being at the commonly accepted good setting height. The engagers of the present invention merely slip over the end plates of the frame with the hooks engaging the pins in the slots of the legs of the headboard. When the hooks are faced upwardly, they engage the pins from below and lift the headboard the recommended distance above the floor and by reversing the engagers, with the hooks pointing down, the legs of the headboard and frame will both rest firmly on the floor. The engagers are interchangeable, that is, there is no left or right, and they are reversible and universal in that they fit all pin settings made in the United States. The economical construction of the engagers render it reasonable to include a pair of engagers with the bed frame thus enabling the headboard to be attached without nuts and bolts and without problems in a very short time.

As illustrated, the side rail of the bed frame is formed from one piece of steel without separate end plates that have to be bolted on and can work loose with the last 6" of the side rail stepping outward in actually two steps which adds to the strength of the end area while still maintaining sufficient flexibility to flex outward to catch an overly wide bed between the slots. The end plate is sufficiently wide to allow enough adjustment to catch the variety of widths between the slots of different bed manufacturers and when the hooks are brought firmly in contact with the steel pins, the wide end plate is brought into snug contact with the surface of the leg post to produce a firm and stable connection in contact to other hook frames where only a small bearing surface of steel is brought into contact with the wood of the headboard leg. By simply sliding the engagers over the end plates of the frame and lining them up to fit into the slots of the legs of the headboard, the frame is prepared with the hooks pointing upward to slip under the pins and suspend the headboard in the air or with the hooks pointing downwardly to fit over the pins putting the legs of the bed and frame firmly on the floor. In the event headboards are encountered whose pin settings are not in accord with the recommended standard of 7" from the lower pin in the leg to the floor, adjustable threaded glides are used to raise the frame height to the pin settings.

FIGS. 7–9 disclose another embodiment of the invention in the form of an engager-extender generally designated by reference numeral 60 and which includes a vertically disposed, laterally extending substantially flat plate 62 which is disposed against the inner surface 64 of the leg 66 of a headboard 68 with the surface 64 including the usual pin slot 70 with vertically spaced transverse pins 72 incorporated therein in a conventional manner. One vertical edge of the plate 62 is provided with a laterally extending flange 74 in perpendicular relation thereto with the flange having a pair of hooks 76 formed thereon to engage with the pins 72 to detachably secure the adapter-extender 60 to the headboard with the hooks including camming inner surfaces 78 to pull the plate 62 tightly against the surface 64 of the headboard leg 66. The lower end of the vertical edge of the plate 62 having the flange 74 is provided with a projecting finger 80 which is coplanar with the plate 62 and engages the surface 64 laterally inwardly of the slot 70 thereby stabilizing the plate 62 so that it is flush against and rigidly associated with the surface 64 and the leg 66.

The opposite vertical edge of the vertical plate 62 is provided with a flange 82 in perpendicular relation to the plate 62 but extending oppositely from the flange 74. The flange 82 is provided with a vertically elongated slot 84 therein which slidably receives the inturned end plate 86 on the bed side rail 88 which structure is the same as the bed rail illustrated in FIGS. 1–6. The slot 84 is associated with the plate 62 so that when the end plate 86 is inserted therethrough, the end plate 86 will be disposed closely adjacent or against the surface of the plate 62. In order to provide stability for the connection between the plate 62 and the plate 86, the top and bottom edges of the plate 62 are each provided with a laterally extending flange 90 which are spaced apart a distance to closely receive the top and bottom edges of the plate 86, respectively. As illustrated, the flanges 90 are formed by a portion of the plate 62 being deformed laterally after two parallel cuts 92 have been made in the top and bottom edges respectively of the plate 62.

The engager-extender 60 is used when a full size headboard is to be connected with a queen size bed frame and bedding, so that when a customer desires to purchase queen size bedding and use it with an already existing full size headboard, a pair of adapter-extenders (a left and a right) are provided so that the side rails 88 of the queen size bed frame and bedding will have their inturned end plates 86 received in the slots 84 and the association of the flanges 90 with the plate 86 and the surface-to-surface engagement of the plate 86 with the plate 62 and the rigid connection between the plate 62 and the leg 66 of the headboard 68 forms a secure connection between the bed frame and headboard. As in the embodiment illustrated in FIGS. 1–6, the hooks on the pair of adapter-extenders can be oriented in an upwardly facing position or a downwardly facing position for the same reasons as the embodiment in FIGS. 1–6. Further, manufacturers frequently provide headboards which are of a queen size but with pin slots in only the full size position. By using a pair of engager-extenders of the present invention, the existing queen size headboard having pin slots spaced therein a standard full size bed width can be utilized with queen size bedding without the necessity of drilling holes in the leg in the queen size position. The engager-extenders allow a queen size bed frame to be hooked to the headboard without the use of nuts and bolts by utilizing the pins in the headboard legs which are positioned for a full size bed. Thus, a full size headboard can be easily converted so that it can be used with the popular queen size bedding and bed frame.

FIG. 10 illustrates another embodiment of the engager-extender generally designated by numeral 94 and which includes a plate 96 generally the same as the plate 62 in FIG. 8 with flanges 98 projecting from the top and bottom edges thereof with the free parallel edges of the flanges 98 being inturned as at 100 to provide a sliding and guided engagement with the end plate 86 on the side rail 88 with the side rail and end plate being identical to that illustrated in FIG. 8. Thus, the structure is simplified as compared to that illustrated in FIG. 8 by eliminating the flange 82 and the slot 84 therein with the flanges 98 and inturned flanges 100 being relied upon to enable the plate 86 to be inserted therebetween and slide with respect thereto.

By using a pair of engager-extenders, any bed frame, after it has been correctly adjusted to properly fit and receive the bedding, can be used for full size slotted bed with full size or queen size bedding and with queen size slotted bed with queen size bedding.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination, a bed frame including a pair of generally parallel side rails having laterally extending end plates oriented generally perpendicular to the side rails, and an engager mounted on each of the end plates, each engager being in the form of a substantially flat hook plate having a pair of vertically spaced hooks on one vertical edge thereof and a vertically disposed slot spaced from the hooks, said vertical slot adapted to slidably receive the end plate on the side rails to enable lateral adjustment of the hook plate in relation to the end plate to align the hooks on the hook plate with slots and transverse pins provided on a headboard thereby enabling the headboard to be connected to the bed frame.

2. The combination as defined in claim 1 wherein each hook plate is invertible to enable the hooks thereon to open upwardly or downwardly with the hooks supporting the headboard off the floor surface when the hooks are disposed upwardly and enabling a heavier headboard to rest firmly on the floor surace when the hooks face downwardly.

3. The structure as defined in claim 2 wherein said hooks include outwardly inclined camming surfaces defining the inwardly facing edges of the hook slots for camming engagement with the pins on a headboard to tightly and snugly draw the end plate against the surface of the headboard adjacent the slot into which the hooks project thereby providing a stable connection between the headboard and bed frame.

4. In combination, a bed frame including a pair of generally parallel side rails having laterally extending end plates oriented generally perpendicular to the side rails, and an engager mounted on each of the end plates, each engager being in the form of a substantially flat hook plate having a pair of vertically spaced hooks on one vertical edge thereof and a vertically disposed slot spaced from the hooks, said vertical slot adapted to slidably receive the end plate on the side rails to enable lateral adjustment of the hook plate in relation to the end plate to align the hooks on the hook plate with slots and transverse pins provided on a headboard thereby enabling the headboard to be connected to the bed frame, each side rail including a vertical, longitudinally extending plate having a lateral offset portion incorporated therein to provide lateral, resilient flexibility to the end portion of the side rail.

5. The structure as defined in claim 4 wherein each hook plate is invertible to enable the hooks thereon to open upwardly or downwardly with the hooks supporting the headboard off the floor surface when the hooks are disposed upwardly and enabling a headboard to rest firmly on the floor surface when the hooks face downwardly, said flat hook plate being of planar construction with the vertical slot spaced from the hooks a distance to orient the laterally extending end plate on the side rail in engagement with the surface of the headboard adjacent the slot into which the hooks project thereby providing a stable connection between the headboard and bed frame.

6. The structure as defined in claim 4 wherein said flat plate includes a laterally extending flange at each vertical edge thereof with the flanges extending in opposite directions from the flat plate, said hooks being formed in one flange and said vertical slot being formed in the other flange with the laterally extending end plate on the side rail being engaged with the surface of the flat plate, said flat plate having laterally extending top and bottom flanges engaged with the top and bottom edges of that portion of the laterally extending end plate engaging the surface of the flat plate to stabilize the engager in relation to the side rail.

7. An engager adapted to connect a headboard of a bed to a bed frame comprising a generally flat plate having hook means along one vertical edge thereof for insertion into a slot in the leg of the headboard and for engagement with transverse pins extending across the slot and means on said plate spaced from said hook means to slidably engage a lateral end plate on the bed frame whereby the hook means can be adjusted laterally and aligned with the pin slot with the engagement of the hook means with the pins connecting the bed frame with the headboard.

8. The engager as defined in claim 7 wherein said hook means includes a pair of hooks, said plate with the hooks thereon being reversible with the hooks facing upwardly to space the headboard from a floor surface or facing downwardly to firmly engage the headboard with the floor surface.

9. The engager as defined in claim 8 wherein said means on the engager plate includes a vertical slot slidably receiving the lateral end plate therethrough with the engager plate being adjustable to any position along the horizontal length of the end plate.

10. The engager as defined in claim 7 wherein said flat plate includes a laterally extending flange at each vertical edge thereof with the flanges extending in opposite directions, said hook means being formed in one flange and said means slidably engaging a lateral end plate on the bed frame being incorporated into the other flange with the flat plate being vertically disposed against the inner surface of a head board leg thereby providing an engager-extender so that queen size bedding and bed frame may be connected with a headboard having full bed size pin slot spacings.

11. The engager-extender as defined in claim 10 wherein said means on the flange engaging the end plate of the bed frame includes a vertical slot in the flange adjacent its juncture with the flat plate so that the end plate on the bed frame will be disposed along the surface of the flat plate, and a pair of laterally extending flanges adjacent the top and bottom of the flat plate for engagement with the top and bottom edges of the end plate on the bed frame to stabilize the end plate on the bed frame with respect to the flat plate.

12. The engager-extender as defined in claim 11 wherein said hook means includes a pair of hooks formed in the flange with the engager-extenders being provided in pairs with each pair including a left hand and right hand engager-extender with the hooks being reversible and facing upwardly to space a headboard from a floor surface or facing downwardly to firmly engage the headboard with the floor surface.

13. In combination, a bed frame including a pair of generally parallel side rails having laterally extending end plates oriented generally perpendicular to the side rails, and an engager-extender mounted on each of the end plates, each engager-extender being in the form of a substantially flat hook plate having a pair of vertically spaced hooks on one vertical edge thereof and means spaced from the hooks adapted to freely slidably receive the end plate on a side rail to enable lateral adjustment of the hook plate in relation to the end plate thereby extending the effective length of the end plate without requiring the manipulation of fastening devices to align the hooks on the hook plate with a slot and transverse pins provided on a headboard thereby enabling the headboard to be connected to the bed frame with the side rails disposed outwardly of, or in alignment with the pin slots, by laterally sliding the engager-extender on the end plate without requiring the use of separate fasteners to fixedly secure the engager-extender to the end plate.

14. The engager-extender as defined in claim 13 wherein said means on the hook plate slidably engaging the end plate includes a pair of vertically spaced laterally extending flanges on the hook plate receiving the end plate therebetween, each of said flanges including an inturned vertical terminal edge overlying and retaining the end plate adjacent the hook plate for slidably and guidingly interconnecting the end plate and hook plate and enabling the side rails to move laterally outwardly when a full size headboard is used with queen size bed frame and bedding.

* * * * *